United States Patent [19]

Faron et al.

[11] 4,139,447

[45] Feb. 13, 1979

[54] ELECTROLYZER FOR INDUSTRIAL PRODUCTION OF FLUORINE

[75] Inventors: Robert Faron, Nyons; Annie Cathala, Livron, both of France

[73] Assignee: Produits Chimiques Ugine Kuhlmann, Paris, France

[21] Appl. No.: 666,495

[22] Filed: Mar. 12, 1976

[30] Foreign Application Priority Data

Mar. 21, 1975 [FR] France ..... 75 09564
Mar. 10, 1976 [FR] France ..... 76 07582

[51] Int. Cl.[2] ..... C25B 1/24; C25B 9/00

[52] U.S. Cl. ..... 204/239; 204/60; 204/244; 204/247; 204/268; 204/270; 204/274; 204/278

[58] Field of Search ..... 204/128, 98, 94, 268, 204/269, 270, 256, 279, 286, 242, 266, 288, 60, 274, 244, 247, 239

[56] References Cited

U.S. PATENT DOCUMENTS

| | | | |
|---|---|---|---|
| 3,146,179 | 8/1964 | Davies | 204/60 |
| 3,576,726 | 4/1971 | Cooper | 204/128 |
| 3,598,715 | 8/1971 | Goens et al. | 204/288 X |
| 3,635,804 | 1/1972 | Gritzner | 204/128 |
| 3,673,076 | 6/1972 | Juckniess | 204/256 |
| 3,778,362 | 12/1973 | Wiechers et al. | 204/286 X |
| 3,860,504 | 1/1975 | Kaudewitz et al. | 204/60 X |

OTHER PUBLICATIONS

*Flourine Chemistry*, Indust. & Engin. Chem., (1947), pp. 247 and 254.

*Primary Examiner*—Arthur C. Prescott
*Attorney, Agent, or Firm*—Dennison, Dennison, Meserole & Pollack

[57] ABSTRACT

A new electrolyzer for the industrial production of fluorine gas which uses bipolar and monopolar electrodes within a tank containing an electrolyte of an anhydrous mixture of mineral fluorides and hydrogen fluoride. A compact construction is achieved which requires only two current connections.

9 Claims, 12 Drawing Figures

ELECTROLYZER FOR INDUSTRIAL PRODUCTION OF FLUORINE

This invention concerns a new electrolyzer for elemental fluorine production which operates with greater economy than known electrolyzers.

The need for elemental fluorine will develop rapidly in the next few years. In particular, fluorine gas is used for uranium hexafluoride production from which uranium enrichment is processed by diffusion. The classical method is described in a report by R. A. Ebel and G. H. Montillon, "Fluorine Generator Development", No. K-858 subject category, chemistry, Carbide and chemicals company, Union Carbide and Carbon Corp., published on Jan. 22, 1952, issued in "category chemistry" in the distribution list for United States Atomic Energy Non-Classified Research and Development Reports, TID 4500 of July 17, 1951.

This method consists in electrolyzing a molten mixture of potassium fluoride and hydrogen fluoride approximating in composition to KF.2HF contained in a rectangular tank of mild steel or "Monel" (International Nickel Co. registered trademark for a nickel-copper alloy, 63 to 68% of nickel with minute quantities of iron, manganese, silicon and carbon). In this electrolyzer the carbon anodes and the iron or "Monel" cathodes are connected in parallel and held in position by the current leads without contact with the tank sides to avoid the shunting of current.

The following figures will assist in understanding the state of the art and the new characteristics of the electrolyzer according to the invention.

Figure 12:
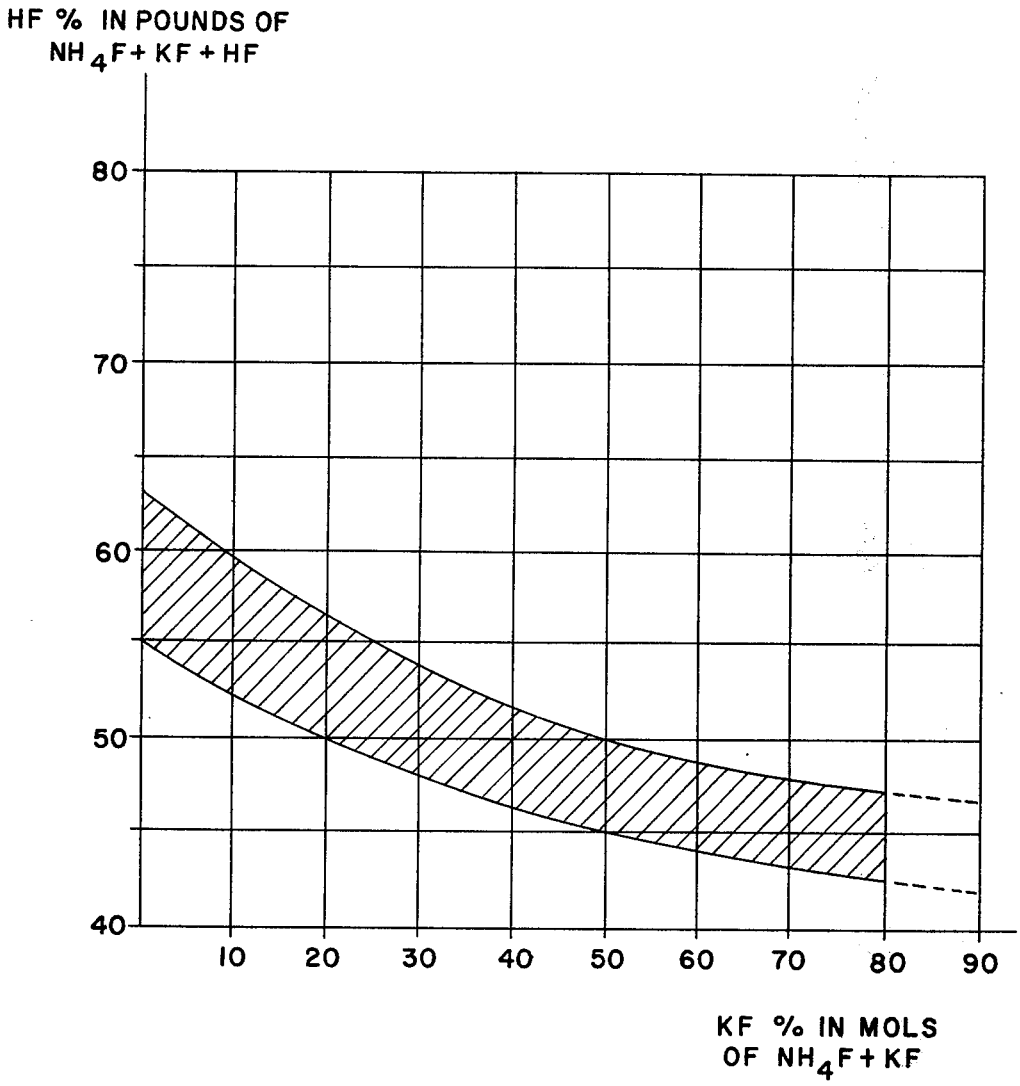

FIG. 12 graphically shows the preferential range of composition of the electrolyte which is used in the electrolyzer according to the invention.

Figure 1:
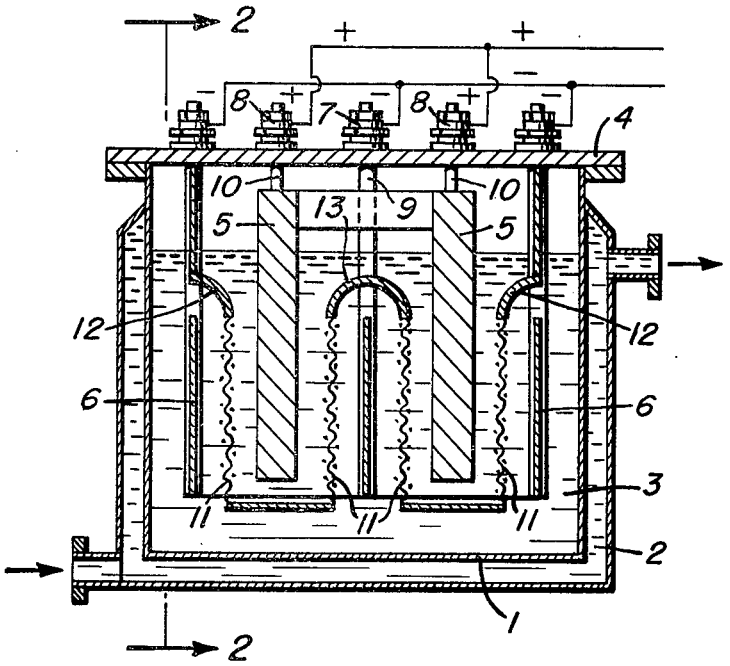
FIG. 1 PRIOR ART
FIG. 1 is a vertical section perpendicular to the electrodes of a known industrial electrolyzer.
Figure 2:
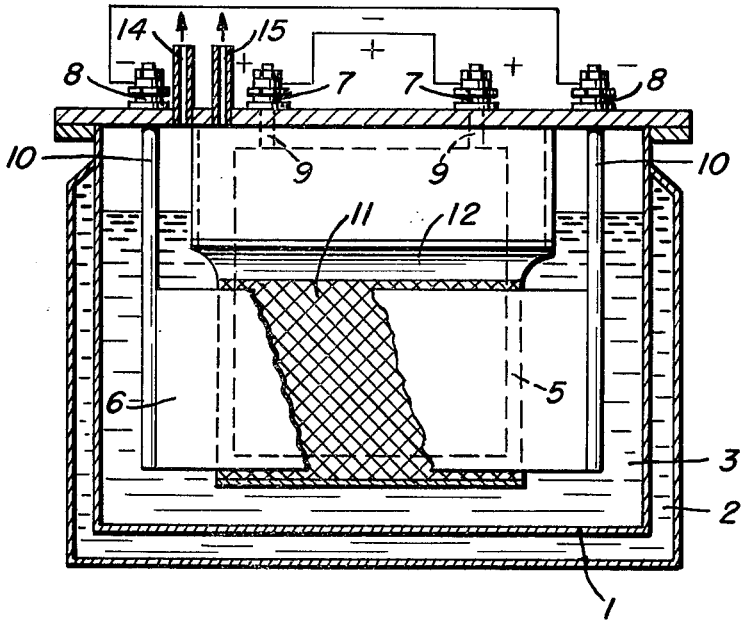
FIG. 2 PRIOR ART
FIG. 2 is a section parallel to the electrodes of the electrolyzer of FIG. 1.

FIGS. 1 and 2 show an industrial electrolyzer corresponding to the classical technic which has just been referred to. The mild steel double walled rectangular electrolyzer tank 1 is water cooled 2. It contains the molten electrolyte 3 approximating in composition to KF.2HF. A "Monel" top 4 is tightly bolted to the tank.

Electrolysis is achieved between the carbon anodes 5 and the iron cathodes 6 held by current leads 9 and 10 which project through the top 4 by insulated holes 7 and 8 and are connected to a direct current source (not shown). There is no contact between these electrodes and the bottom or the walls of the tank. Anodes and cathodes are connected in parallel.

Diaphragms 11 made of a fine "Monel" wire screen are placed between anodes and cathodes. These diaphragms are topped by tightly fixed "Monel" partitions 12. These partitions are longer than the electrodes, are closed on both sides and dip in the bath. The median partition 13 which looks like an inverted gutter is only fixed at both ends. So are delimitated closed volumes surrounding the upper part of each electrode, and limited by the bath, the partitions 12 and 13 and the top 4. Thus, hydrogen can be collected on the cathodes and fluorine on the anodes without any risk of mixing. Hydrogen is piped outside the electrolyzer through the tube 14 and fluorine through the tube 15.

The melting point of the bath being around 70° C., the usual working temperature ranges from 80° to 110° C. In these conditions, due to the partial pressure of hydrogen fluoride over the KF.2HF system, the fluorine and the hydrogen collected contain around 6 to 8% in volume of HF.

The working voltage of electrolysis is about 10 volts and the current density is around 15 A/dm$^2$. The average Faraday efficiency approximates 90% and the energy efficiency is very low because the reversible voltage of the decomposition of HF reaches only about 2.8 volts. This type of prior art electrolyzer is characterized by serious drawbacks: its low productivity, a bad energy efficiency which tends to overheat the bath and limits the working current densities; the high working temperature enhances material corrosion by the bath and by HF also the maintenance costs are high.

For many years scientists have tried to improve the efficiency and productivity of the fluorine industrial electrolyzer. In French Pat. 2,082,366, of Societe des Usines Chimiques de Pierrelatte, it is proposed to replace the usual electrolyte by ammonium fluoride containing 55 to 63 of HF in weight percent. This electrolyte has a melting point between −6° C. and +23° C., and allows working at room temperature. In these conditions, the HF partial pressure is lowered and the HF content of the produced gases is smaller. The lower resistivity of this electrolyte enables an increase in the current density and its lower anodic overvoltage improves the energy efficiency. The same patent also teaches the possibility of replacing up to a fourth of $NH_4F$ in molar fraction by the same quantity of KF. The French Pat. No. 2,145,063, first addition to No. 2,082,366, proposes to substitute for steel tanks less expensive plastic tanks, whose use is made possible by the lower working temperature permitted by $NH_4F$-HF.

In spite of these improvements much could still be done to realize an electrolyzer having improved current and energy efficiencies and higher compacity. To meet this goal it was necessary to lower the energy losses due to bad electrical contacts between electrodes and current leads and to reduce the distance between electrodes and increase the current density with a temperature of bath as low as possible and to avoid the current losses between the electrodes and the walls of the tank.

To solve these problems, the idea was conceived of making a new type of electrolyzer for fluorine production with bipolar electrodes. This type of electrolyzer which is used in the water-electrolysis industry was thought inadequate for fluorine because of the lack of insulating materials resisting to electrolyte and gases, and also because of the increased risks of mixture of hydrogen and fluorine coming from the two opposite faces of the same electrode.

The design of the new electrolyzer according to the invention has permitted a solution to the problems which existed and to obtain remarkable advantages in comparison with the older electrolyzers equipped with monopolar electrodes. In fact, such an electrolyzer allows a compact construction in which it is possible to have only two current connections, one to each end.

The voltage drop due to connections of electrodes in series from one electrolyzer to another is practically eliminated, due to bipolar electrodes and the working surface of each electrode is nearly equal to the inside cross section of the electrolyzer. To avoid hydrogen and fluorine mixtures, it is necessary to tightly join the edges of the electrodes to the walls and the top of the electrolyzer. This necessitates the use of an insulating material for the walls of the electrolyzer or at least for the inside surfaces of these walls. To reduce the losses of energy by Joule effect, and the aggressiveness of the bath, it is better to use a bath with a higher conductivity and a lower melting point.

In spite of the reduction of the thermal losses, the smaller size of the electrolyzer for a same output make it necessary to develop an effective cooling system. In the new type of electrolyzer according to the invention, the use of bipolar electrodes has been combined with the use of insulating materials for the structural parts of the electrolyzer. These insulating materials are in contact with the electrolyte and with the gases evolved on the electrodes. The structural parts can be made of an inner conductive material such as steel which is covered on the outside by a layer of an insulating material which alone comes in contact with the electrolyte and the gases. The electrolyte is a mixture of $NH_4F$ and HF with an addition of KF. In most cases it is thus possible to have a working temperature lower than 40° C. and even, if necessary, lower than 20° C. A systemic circulation of the electrolyte is necessary for cooling when current densities corresponding to the needs of industrial production are used. The cooling is done by any means known in the art such as double wall, or tubes in which a cooling fluid is circulated. If necessary, one or several pumps can accelerate the circulation of the electrolyte.

The following nonlimiting examples describe two different forms of electrolyzers according to the invention.

EXAMPLE I

The following electrolyzer is a relatively small unit which can be easily increased in size for industrial purpose.

Figure 3:
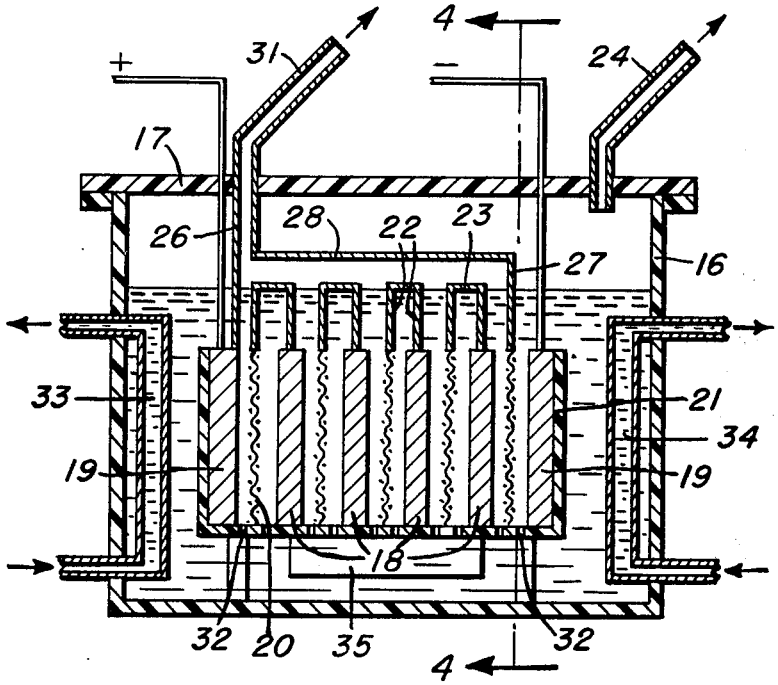
FIG. 3 is a section perpendicular to the electrodes of an electrolyzer according to the invention comprising a double tank.
Figure 4:
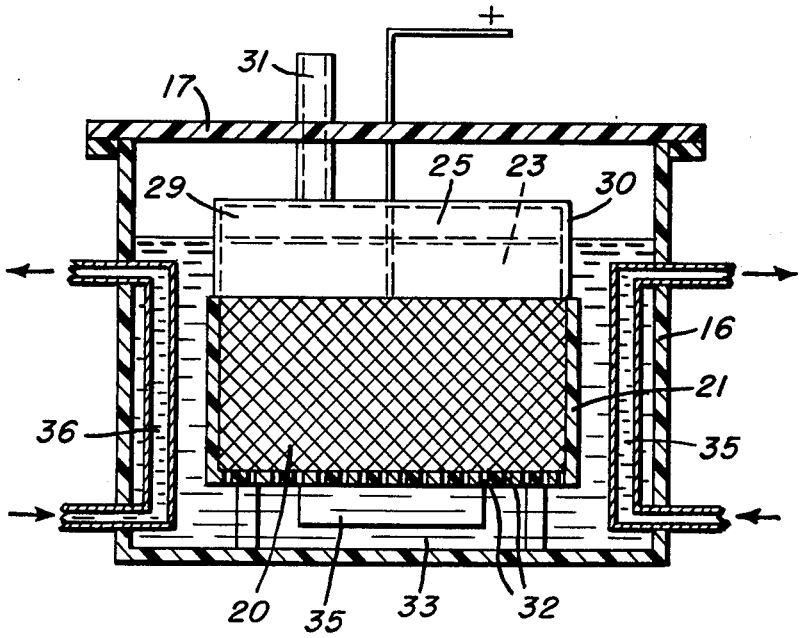
FIG. 4 is a section parallel to the electrodes of the electrolyzer of FIG. 3.

FIG. 3 and FIG. 4 represent this electrolyzer along two views at right angles. It comprises a tank 16 formed of polymethylmethacrylate with an insulated top 17 of the same material with six vertical carbon electrodes, four being bipolar 18 and two monopolar 19. The two monopolar electrodes at each end are connected to positive and negative poles of a DC current source. Each electrode is tightly joined to the walls and the bottom of the inner tank 21 inside the main tank 16. This inner tank 21 is also formed of polymethylmethacrylate. Between two electrodes, a diaphragm 20 made of graphite cloth separates anodic and cathodic zones.

Diaphragms and electrodes are completely immerged and joined tightly to "Monel" partitions 22 placed at their top and whose lower end penetrates a few centimeters in the electrolyte. Above cathodic zones, the vertical partitions 22 are joined by horizontal partitions 23 to form inverted gutters. Hydrogen gas is collected in these gutters and fulfills the top part of the tank 16 before going out through the pipe 24.

Above the anodic zones, fluorine is collected in a volume 25 limited by "Monel" partitions 26, 27, 28, 29 and 30 which are tightly assembled together by welding. Fluorine thus collected in 25 then goes through the pipe 31 outside the electrolyzer and is gathered in receiver means not shown.

Teflon gaskets are used to make all connections gas tight and also to electrically isolate the "Monel" partitions 22 and the diaphragms and carbon electrodes to which they are assembled. Circulation of the electrolyte for cooling is done by a thermosiphon. To obtain this result, the bottom of the inner tank 21 has holes 32 which allow free circulation of the electrolyte from the outside to the inside of inner tank 21. In the upper part of the cathodic zones, the electrolyte communicates freely through the inverted gutters with the space between the two tanks.

The Joule effect increases the temperature of the electrolyte in the spaces between the electrodes whereas the water cooling system 33, 34, 35, 36 lowers that temperature in the space between the two tanks 16 and 21 thus creating a hydrodynamic current. The flow of hydrogen through the inverted gutters also facilitates this current. If the electrolyte is composed of $NH_4F$ and HF with 58 HF in weight percent, it is possible to maintain its average temperature at 28° C.

With this electrolyzer and this electrolyte, an operating test of 720 hours was done in the following conditions: the useful surface of each side of the electrodes was 2.4 $dm^2$, the distance in the electrolyte between two successive electrodes was 2 cm, the average current total intensity 36 amperes, with a total voltage of 30 volts, that is to say, 6 volts per element. Fluorine production was 68.4 l/h corresponding to a 95% faraday efficiency. The concentration of HF in the fluorine was 2.4% in volume instead of about 6 to 8% as in a standard electrolyzer. The consumption of energy is 40% lower due to the lower voltage, which represents a significant advantage. Furthermore, this electrolyzer presents a much higher degree of compactness than the standard electrolyzers. This is a great advantage for the construction of large industrial units for the electrolytic production of fluorine.

In this electrolyzer, several modifications can be realized without going out of the invention. Especially it is possible to use several other plastic materials such as polyethylene, polypropylene, or polycarbonates. It is possible also to use polytetrafluoroethylene and polytetrafluorochloroethylene. These last materials can also be used for gaskets. Instead of using massive plastic, it is possible also as noted earlier to use another material, such as steel, protected by a layer of plastic. The circulation of the electrolyte can be accelerated by a pump. That pump made for example of graphite can be placed between the two tanks or even on the outside of the electrolyzer.

In comparison with the previous technics, such an electrolyzer is an improvement because of its compactness, its energy efficiency and the quality of the fluorine produced. However, its complexity due to the double tank for the circulation of the electrolyte, and the collecting system for produced gases makes it expensive. The efficiency of the collection of fluorine and hydrogen depends on the tightness of the partitions placed in the upper part of the electrolyzer. Accidents may result from faulty welds or gaskets.

A second electrolyzer according to the invention has been built which presents a sturdier construction.

EXAMPLE II

Figure 5:
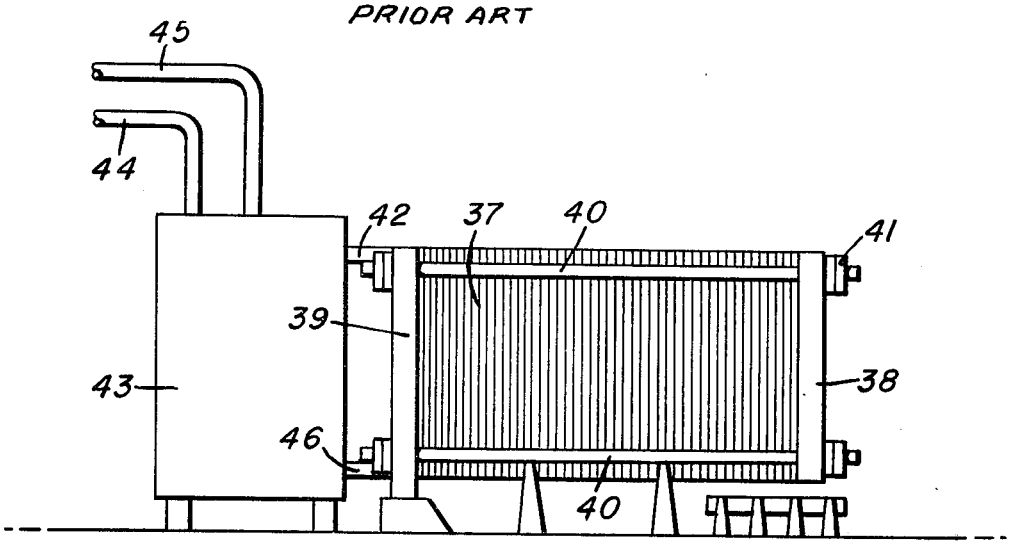
FIG. 5 PRIOR ART
FIG. 5 shows a known press electrolyzer for electrolysis of water.

This electrolyzer according to the invention incorporates in part the teaching given by "Applications de l'Electrochimie" by W. A. Koehler, published by Dunod-Paris 1950. In this book, an electrolyzer of the press filter type designed by Pechkranz is described at pages 388–389, figures 146–147. It is an electrolyzer for production of $O_2$ and $H_2$ from water. FIG. 5 is a general view of this electrolyzer wherein 37 shows generally a structure characterized by anodic and cathodic compartments separated by a porous diaphragm. Bipolar electrodes are maintained between two cast iron end plates 38, 39 by means of rods 40 and screws 41. Electrically insulated and tightly joined gaskets are disposed between electrodes and diaphragms. Positive and negative electrical leads are connected to the end plates 38 and 39 which are insulated from the rods and the bottom. These end plates are in fact the two outer electrodes of this electrolyzer. Two pipes 42, only one visible, are connected one to the anodic compartments, and the other to the cathodic compartments. They carry respectively hydrogen gas and oxygen in the two compartments of the separator 43. These compartments are not shown in the figure. In one of these compartments, hydrogen gathers in the upper part and goes through pipe 44 to receiving means, not shown. In the second compartment, oxygen gathers in the same way and goes through pipe 45 to receiving means not shown.

Figure 6:
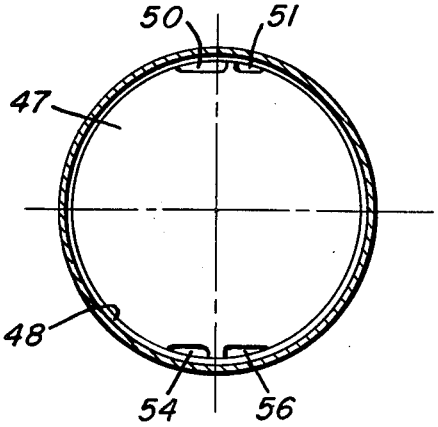
FIG. 6 PRIOR ART
FIG. 6 and FIG. 7 show respectively a bipolar electrode and a diaphragm of the press of electrolyzer of FIG. 5.

The electrolyte from separator 43 comes back to the electrolyzer by two pipes 46, only one visible. FIG. 6 shows a bipolar electrode used in the electrolyzer. It is made of mild steel nickel plated on one face (anode face). Around the anode, there is a groove 48 for a rubber gasket, electrically insulated. In the electrolyzer 37 this gasket will come in contact with the diaphragm 49 shown in FIG. 7. This diaphragm is made of a nickel sheet which presents a multitude of small holes. The other side of the electrode 47 in the electrolyzer will come in contact with another diaphragm such as 49 by means of another gasekt. The thickness of the gaskets determines the width of the anodic and cathodic compartments.

Electrodes 47 and diaphragms 49 have orifices which are joined together by gaskets so as to form passages all along the electrolyzer. Electrodes and diaphragm orifices 50 and 52 collect hydrogen. On the contrary, electrodes and diaphragm orifices 51 and 53 collect oxygen. Outlets (not shown) are provided from each cathodic and anodic compartment respectively through the junction between 50 and 52 and the junction between 51 and 53. Hydrogen and oxygen thus collected, together with some quantities of electrolyte, pass through pipes 42 to the separator 43 as explained before.

Electrodes and diaphragms have in their lower part orifices 54, 55, 56 and 57 through which electrolyte separated in 43 returns to the electrolyzer. Inlets (not shown) are provided through the junction between 54 and 55 and between 56 and 57. In this way, the electrolyte coming back from the hydrogen compartment of the separator returns to the cathodic compartments and the electrolyte from the oxygen compartment of the separator returns to the anodic compartments.

Such an electrolyzer is not usable for production of fluorine, because the materials used are not resistent to fluorine or fluorides. If instead of iron electrodes, carbon electrodes are used, it is easy to see that the same kind of structure cannot be realized due to the brittleness of carbon electrodes. But, it has been found that it would be highly desirable to design an electrolyzer according to the invention which could be disassembled more easily than the electrolyzer described in Example I. In this Example II, the electrolyzer according to the invention which is described can be easily disassembled as it will appear from the following description.

Figure 8:
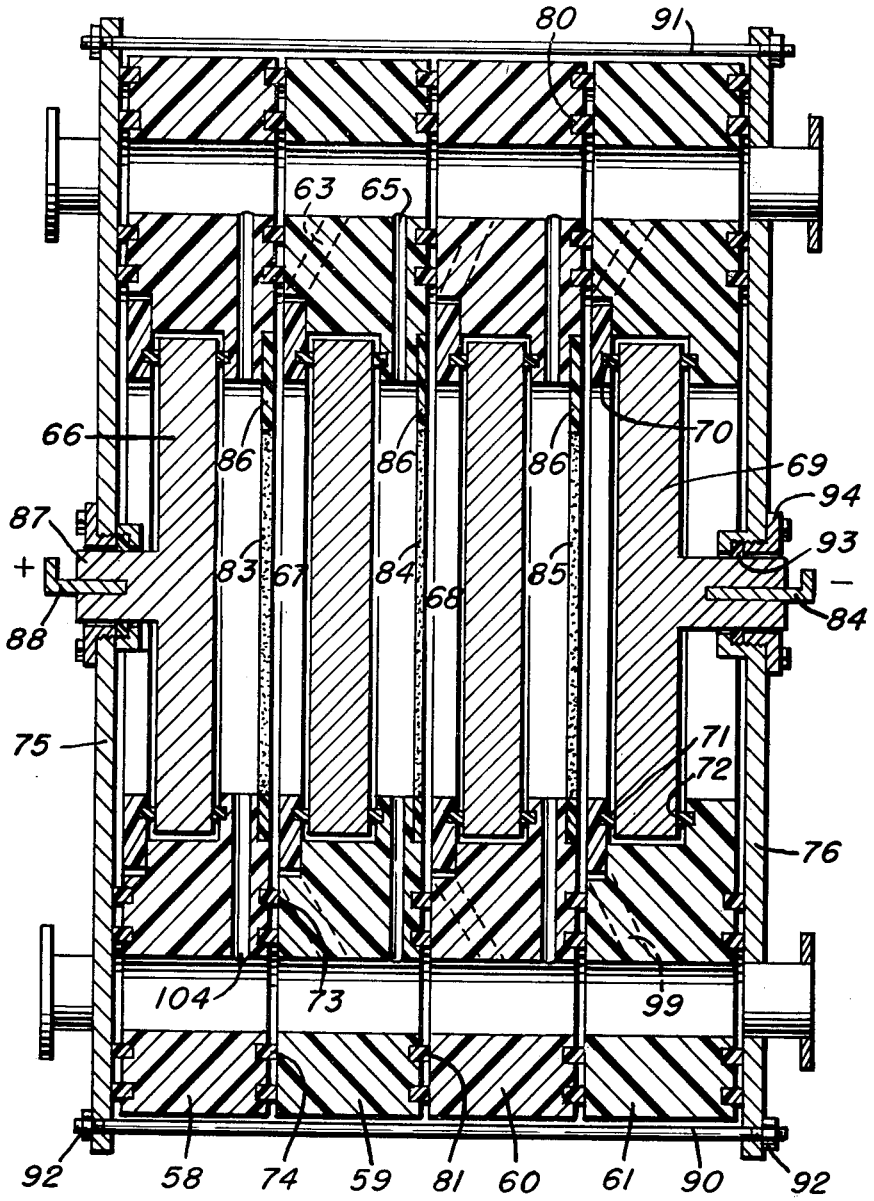
FIG. 8 is a section perpendicular to the electrodes of an electrolyzer according to the invention whose structure is made of assembled frames.

FIG. 8 represents an electrolyzer according to the invention comprising only three elementary cells in series to facilitate the understanding of its assembly. This electrolyzer is composed of four polymethylmethacrylate frames 58, 59, 60, 61 with orifices at each corner as seen on FIG. 10. Orifice 62 is connected by ducts 63 drilled through the frame to the cathodic compartment of each elementary cell and collects hydrogen from this compartment. Orifice 64 is connected by ducts 65 to the anodic compartments of each elementary cell and collects fluorine gas. Inside each frame, there are carbon electrodes 66, 67, 68, 69 fixed with a suitable clearance to avoid mechanical tension, resulting for example from thermal expansion, within a housing machined in the frame.

Figure 10:
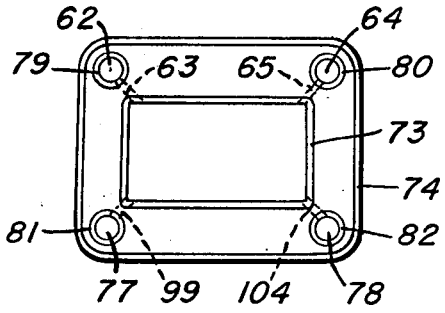
FIG. 10 shows one frame according to the invention.

A second removable frame 70 formed of like material maintains the carbon electrode in the housing. It is held in place by screws or adhesive. Each electrode is sealed tightly to the frames by gaskets 71, 72. These gaskets must resist corrosion caused by the electrolyte and the gas. They must not leak and nevertheless they must be resilient enough to accommodate some differential thermal expansion. For that application, polytrifluorochlorethylene gaskets give satisfactory results. Each main frame is insulated from the next one with a gasket of polytrifluorochlorethylene 73, 74. FIG. 10 shows that gasket 73 follows the inner edge of the frame, and gasket 74 the other edge. "Monel" plates close opposite faces 75, 76. FIG. 10 shows that each orifice 62, 64, 77, 78 is encircled by a gasket 79, 80, 81, 82. Diaphragms 83, 84, 85 separate anodic and cathodic compartments. These diaphragms are surrounded by a polymethylmethacrylate thin frame 86 which is received in a housing machined in the main frame. The diaphragms themselves are porous walls made of pressed and sintered small polymethylmethacrylate balls having an individual diameter of a few tenths of a millimeter.

These porous walls have no electrical resistance but forbid gas diffusion. Electrodes 66 and 69 are monopolar and connected to the direct current source. Electrode 66 is a carbon anode which is extended on one side by a cylindrical carbon part 87 in which a copper lead 88 is screwed. In the same way, the cathode 69 is connected to the current source by the copper lead 89. Four rods, of which two are visible 90, 91 with bolts 92, 92', are attached to the four corners of each end plates 75, 76, and maintain the assembly together. The rods and bolts are insulated from the end plates by usual means. The cylindrical carbon extension of the end electrodes 66 and 69 are tightly joined to the end plates by polytrifluorochlorethylene gaskets such as 93 pressed by the annular part 94.

Figure 9:
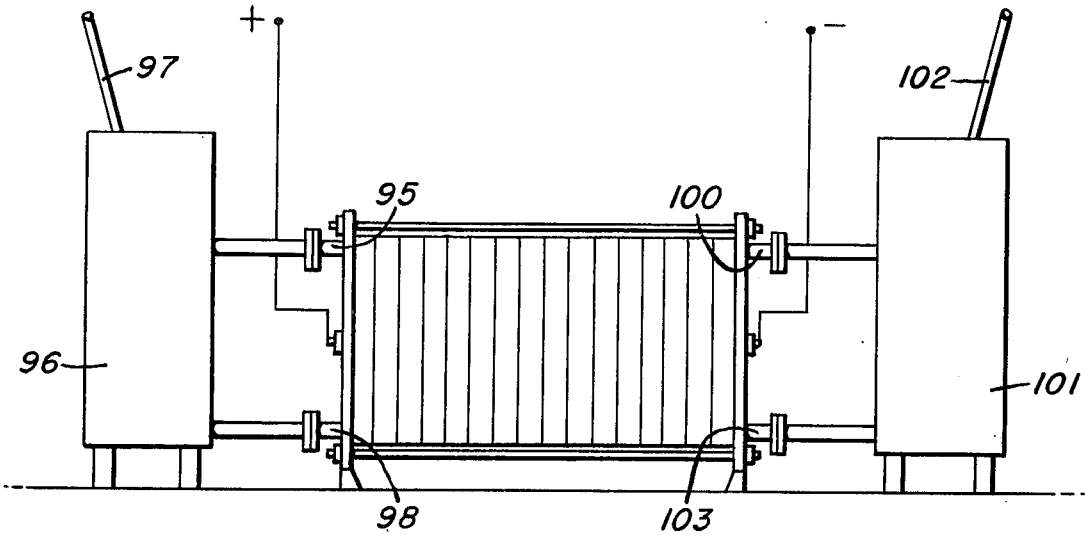
FIG. 9 shows an electrolyzer according to the invention whose structure is made of assembled frames, seen from outside with its separators.

FIG. 9 shows a cell with sixteen frames, or fifteen elements. These elements are identical to those of FIG. 8. As described previously, during electrolysis, hydrogen gas is collected in 62 and passes through the end plate by pipe 95 which is connected to separator 96. From this separator, hydrogen is conducted by pipe 97 to receiving means not shown. The electrolyte which was carried by the hydrogen flow returns to the electrolyzer from the separator by a pipe 98 and orifice 77, and ducts 43. Fluorine is collected in 64 and goes through pipe 100 to separator 101. It is sent to receiving means by pipe 102. The electrolyte separated returns to the anodic compartments through pipe 103, orifice 78 and ducts 104.

Figure 7:
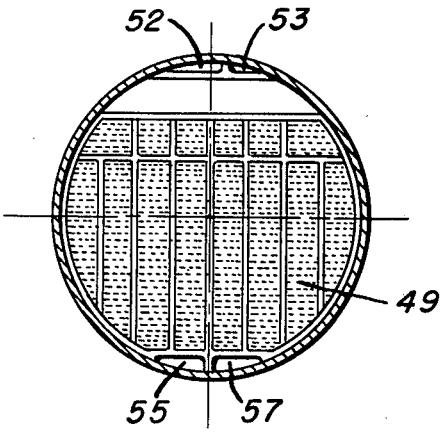
FIG. 7 PRIOR ART

Pipes 95, 98, 100, 103 are formed of "Monel" as the separators 96, 101. In these separators the electrolyte is cooled by means of a cooling fluid circulating in a double wall to the desired temperature before coming back to the electrolyzer. Pumps can be used to accelerate the circulation of the electrolyte. These pumps can be made of graphite. An electrolyzer as shown in FIG. 7, with three elementary cells in series, has been tested for 750 hours with a bath composition $NH_4F$ + 2.5 HF. The distance between electrodes was 2 cm and the working surface of each electrode, measured on one side, was 2.4 dm2. Electrical current was 38 A and voltage 18 volts (6 volts per element).

In these conditions, the production of fluorine was 43.9 l/h measured in normal conditions of temperature and pressure. This is corresponding to a faraday efficiency of 97%. Working temperature was 27° C. and HF content in fluorine was around 2.3%. This electrolyzer has the advantage of a higher degree of compactness than the electrolyzer described in Example I. Its design is simpler and more sturdy. The ability to dismantle it easily is a great advantage for maintenance. Finally, it has an energy efficiency as high as the electrolyzer of Example I. For the building of this electrolyzer, it is possible to use other materials than those described. For the frames instead of polymethylmethacrylate, it is possible to use polycarbonates or polyfluorinated polymers such as polytetrafluorethylene or polychlorofluorinated polymers such as polytrifluorochlorethylene or eventually other plastic materials such as polypropylene or polyethylene.

For diaphragms, it is possible to use plastic material in various conditions: sintered particles, perforated sheets, or woven fibers. Instead of plastics, carbon fibers or tissue, or sintered alumina can be used. Metals or alloys such as nickel or "Monel" can be employed also for diaphragms made of perforated sheets or fine wire screens. Further, it is possible to use diaphragms made of plastic or carbon fibers reinforced by metallic wires.

For the electrodes, instead of carbon it is possible to use other materials such as "Monel" or nickel, especially for the cathodic side. For bipolar electrodes, a duplex structure associating for example carbon on the anodic side and a metal on the cathodic side, is contemplated. The fastening of the electrodes inside the frames can be done by means other than gaskets such as shown in FIG. 8.

Figure 11:
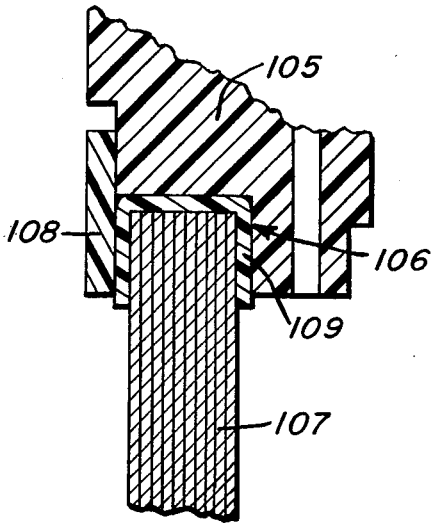
FIG. 11 shows a detail of a tight joint between an electrode and a frame according to the invention.

FIG. 11 shows a different way in which a carbon electrode can be joined tightly to a plastic frame. In that figure which is a transverse section, there is shown a part of the frame 105 with the housing 106 in which is loosely fitted the edge of the electrode 107. The housing is closed by part 108 which is a removable second plastic frame which is screwed or otherwise secured to the main frame. The clearance between the edge of the electrode and the housing is maintained by a soft and resilient material 109 which envelops the edges of the electrode. This material is a carbon tissue, and can be also a plastic tissue made for example of polytetrafluorethylene. In this way the carbon electrode is joined tightly to the frame, but some slight displacements are possible without undue stresses. Part 108 can also be formed by casting the plastic material as a liquid monomer after having placed the electrode with its edges protected in the way just described, in the housing, and later polymerizing it.

Experiments have shown that it was possible to limit the corrosive action of electrolytes made of mixtures of $NH_4F$ + HF by adding KF to them. That introduction increases the life of the carbon electrodes. Table I gives examples of compositions of electrolytes containing $NH_4F$ + HF + KF with their melting points.

TABLE I

| Bath No. | Contents of $NH_4F$ and KF in mole per cent of $NH_4F$ + KF | | HF in weight per cent of $NH_4F$ + KF + HF | Melting Points |
|---|---|---|---|---|
| | $NH_4F$ | KF | | |
| 1 | 70 | 30 | 52 | 15° C |
| 2 | 50 | 50 | 48 | 28°°C |
| 3 | 30 | 70 | 46 | 37° C |

It appears from this table that the melting point of the electrolyte increases slowly when the percentage of KF is increased. When the percentage becomes higher than about 80% the melting point of the electrolyte becomes too high for using an electrolyzer made of plastic materials.

FIG. 12 is a diagram in which the useful range of composition of electrolytes which can be used in electrolyzers according to the invention is presented. In this diagram, the percentages of KF in mole percent of $NH_4F$ + KF are in abscisses and the percentages of HF in weight percent of $NH_4F$ + HF + KF in ordinates, the useful range of composition of the electrolyte is represented by the striped surface.

This electrolyzer can be operated at a pressure higher than atmospheric pressure. This result can be obtained by means known in the art. If the mechanical resistance of the structure of the electrolyzer is not high enough for the pressure which is needed, it is possible to place this electrolyzer and also the separators in a pressurized tank. It is then possible to fill cylinders directly with hydrogen and fluorine at the required pressure.

In this electrolyzer, the necessary adjustments of the electrolyte can be done easily by introduction from time to time of determined additions in the separators.

We claim:

1. An electrolyzer for the production of fluorine from a low temperature fused anhydrous electrolyte comprising a tank for containing the electrolyte and comprised of walls having electrically insulated surfaces generally inert to the electrolyte, at least two monopolar electrodes adapted to be connected to a source of direct current and a plurality of bipolar electrodes positioned between the monopolar electrodes, said electrodes being positioned in said tank for immersion in the electrolyte wherein anodic and cathodic zones are established, means for substantially precluding gas diffusion between the anodic and cathodic zones, means for separately collecting gases evolved from the anodic and cathodic zones, and means for limiting the working temperature of the electrolyte.

2. An electrolyzer as defined in claim 1 wherein said bipolar electrodes are formed of carbon.

3. An electrolyzer as defined in claim 1 wherein the walls of said tank are formed of an insulating material.

4. A electrolyzer as defined in claim 3 wherein the walls are formed of a plastic.

5. An electrolyzer as defined in claim 3 wherein the walls are formed of metal having an insulating coating.

6. An electrolyzer as defined in claim 1 and further including pump means for circulating the electrolyte and cooling means to limit the temperature of the electrolyte.

7. An electrolyzer for the production of fluorine from a low temperature fused anhydrous electrolyte comprising an electrolyzer cell means including two monopolar electrodes adapted to be connected to a source of direct current, a plurality of bipolar electrodes positioned between said monopolar electrodes, said electrodes being separated from each other by insulating frame means wherein anodic and cathodic zones are established, said frame means including means for precluding gas diffusion between the anodic and cathodic zones, means for separately collecting gas evolved from the anodic and cathodic zones, said frame means including a plurality of frames, said frames being perforated on their upper surface to permit electrolyte and gases evolved on the electrodes to pass, said electrolyte and gases passing to separator means for cooling the electrolyte, and perforations in the lower portion of said frames for the return of the electrolyte from said separator and receiving means for receiving the gases from said separator.

8. An electrolyzer as set forth in claim 7 wherein said frames are formed of plastic.

9. An electrolyzer as defined in claim 7 and further including diaphragm means in each frame to separate anodic and cathodic compartments, said diaphragms having porous walls.

* * * * *